US006783265B2

(12) United States Patent
Haugaard et al.

(10) Patent No.: US 6,783,265 B2
(45) Date of Patent: Aug. 31, 2004

(54) SUSPENSION STABILIZERS FOR OVERHEAD LIGHTING FIXTURES

(75) Inventors: Eric Haugaard, Kenosha, WI (US); Kurt Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 10/294,969

(22) Filed: Nov. 14, 2002

(65) Prior Publication Data

US 2004/0095774 A1 May 20, 2004

(51) Int. Cl.[7] ..... F21V 21/02

(52) U.S. Cl. ..... 362/396; 362/147; 362/368; 362/404

(58) Field of Search ..... 362/396, 404, 362/391, 147, 368; 248/339–344, 322

(56) References Cited

U.S. PATENT DOCUMENTS 4,303,968 A * 12/1981 Goralnik ..... 362/147
5,653,531 A * 8/1997 Yang ..... 362/352
5,902,035 A * 5/1999 Mui ..... 362/267
6,304,702 B1 * 10/2001 Potucek et al. ..... 385/115
2002/0071284 A1 * 6/2002 Fischer et al. ..... 362/370

OTHER PUBLICATIONS

WideLite Genlyte Thomas Installation Instructions ("VAO/VAE/VPS") Verticaisle Reflector Series (2 pages) WL Part No. 801185 Rev. D (8/00).

* cited by examiner

*Primary Examiner*—Alan Cariaso
*Assistant Examiner*—Mark Tsidulko
(74) *Attorney, Agent, or Firm*—Jansson, Shupe & Munger, Ltd.

(57) ABSTRACT

An overhead industrial light fixture suspended by a hook from a support assembly having a suspension stabilizer that engages the hook and is attached to the support assembly. The suspension stabilizer has two slots sized to receive and frictionally hold the upward and downward portions of the hook individually. A method for stabilizing the orientation of a suspended overhead industrial light fixture.

20 Claims, 3 Drawing Sheets

SUSPENSION STABILIZERS FOR OVERHEAD LIGHTING FIXTURES

FIELD OF THE INVENTION

This invention is related generally to overhead industrial light fixtures.

BACKGROUND OF THE INVENTION

A wide variety of overhead industrial light fixtures exist to provide illumination in various factory and warehouse settings. One common use of such fixtures is as aisle lighting. Certain overhead aisle light fixtures need to maintain a specific orientation to the area being illuminated to insure that the most effective lighting of that area is achieved.

Overhead aisle light fixtures are typically suspended from the ceiling in a row centered above the aisle. The elliptical reflectors used on most such aisle light fixtures attain maximum illumination of the aisle below them by having an orientation where the long axis of the reflector is at a 90° angle to the direction of the aisle. There are a number of problems, however, with maintaining this most preferred orientation whenever these light fixtures are in operation.

A common manner of suspension for an overhead aisle light fixture is by means of an eye bolt extending down from the ceiling and over the middle of the aisle. A hook attached to the top of the light fixture is then inserted through the opening in the eye bolt. The very nature of this attachment, in combination with breezes from fans operating in the building and other forces acting on the fixture from time to time, will cause periodic rotation of the fixture away from its desired orientation.

In the prior art, one approach taken has been to stabilize such aisle light fixtures through suspension of the fixture from a rigid electrical conduit. This approach can be quite expensive given the cost of both materials and labor to install such a connection. It also makes more cost-prohibitive any thought of later relocating the light fixture due to a redesign of the configuration of the aisle.

Another approach is represented by the "hang-straight clip" used by Genlyte Thomas on their Wide-Lite® aisle lighting. The clip is attached to an assembly located beneath a hook extending from the light fixture. As the light fixture hangs from a suspended eye bolt by means of the hook, an upper edge on the clip, when positioned against the surface of the eye bolt, provides resistance against movement of the light fixture away from a given orientation with the aisle. This clip is unable, however, to capture or trap the hook in such a fashion as would lock both it and the eye bolt in a chosen orientation.

This invention addresses these problems and shortcomings with a mechanism that is distinct and significantly less complex than the prior art.

OBJECTS OF THE INVENTION

It is an object of the invention to provide a suspension stabilizer for use with overhead industrial lighting fixtures that overcomes some of the problems and shortcomings of the prior art.

Another object of the invention is to provide a suspension stabilizer for use with overhead industrial lighting fixtures that maintains such fixtures in a chosen orientation.

Another object of the invention is to provide a suspension stabilizer for use with overhead industrial lighting fixtures that is simple in size and shape so as to be pleasing in appearance.

Still another object of the invention is to provide a suspension stabilizer for use with overhead industrial lighting fixtures that is easy and inexpensive to manufacture, easy to ship and store, and easy to install and service.

Yet another object of the invention is to provide a suspension stabilizer for use with overhead industrial lighting fixtures that insures overhead aisle lighting fixtures are maintained at a preferred orientation wherein the long axis of the reflector is perpendicular to the direction of the aisle.

Another object of the invention is to provide a suspension stabilizer for use with overhead industrial lighting fixtures that locks a hook attached to the overhead industrial lighting fixture to the means by which the lighting fixture is suspended.

How these and other objects are accomplished will become apparent from the following descriptions and the drawings.

SUMMARY OF THE INVENTION

This invention is for a suspension stabilizer to be used on an overhead industrial light fixture of the type suspended by means of a hook from a support assembly. The stabilizer body has a first slot and a second slot wherein each slot is sized so that the upward portion of the hook fits into and is secured by the first slot and the downward portion of the hook fits into and is secured by the second slot. After the hook has been positioned into both slots, the stabilizer is attached to the support assembly whereby the light fixture can maintain a particular orientation.

In one preferred embodiment, the stabilizer is used with a type of support assembly wherein the support assembly has an opening through which the hook is inserted. The most common form of such a support assembly would be an eye-bolt. In such an embodiment, the stabilizer is preferably secured to the support assembly with a fastener.

Where the light fixture is suspended by a hook inserted through an opening in the support assembly, it is most preferred that the hook be attached to the light fixture and the support assembly be attached to an overhead ceiling structure. With many models of industrial lighting fixtures, such as aisle lighting fixtures, this hook will usually be attached during assembly and extend from the top of the ballast housing. The stabilizer can also be used where the hook is attached to the top of the lighting fixture after assembly of the fixture such as at the time of installation. In certain other preferred embodiments, a support assembly such as an eye-bolt is attached instead to the light fixture and the hook is attached in turn to some overhead ceiling structure.

A highly preferred embodiment has the stabilizer used with a hook that is flat. Another preferred embodiment is one where the upward and downward portions of the hook have a rectangular cross section.

One other preferred embodiment is where the stabilizer body consists of a rail. Most preferably in such embodiments, the hook is attached to the light fixture. This embodiment of the stabilizer body is used where the form of support assembly is commonly two lengths of cable. In such embodiments, the rail is preferably attached to the support assembly by a fastener at each end of the rail.

The invention further includes a method for stabilizing the orientation of a suspended overhead industrial light fixture. The method of this invention begins with suspending the light fixture by a hook from a support assembly in a desired orientation. The hook will define an upward portion and a downward portion at its point of engagement with the support assembly. A stabilizer body having a first slot and a second slot is then placed over the hook. The first slot of the stabilizer body is positioned so that it engages the upward portion of the hook and likewise the second slot is positioned over the downward portion of the hook to engage it. Afterwards, the stabilizer body is secured to the support assembly.

In certain preferred embodiments of this method, the hook is flat. In other preferred embodiments of this method, the support assembly is an eye-bolt. It is particularly preferred that the securing of the stabilizer body to the support assembly through this method be by engaging the two pieces with a fastener.

In another preferred embodiment of this method, the stabilizer body is a rail. It is most preferred in this embodiment that the rail have two ends so that securing it to the support assembly be by engagement of a fastener at each end.

DETAILED DESCRIPTION OF PREFERRED EMBODIMENTS

The drawings illustrate an overhead industrial light fixture 10 suspended by a hook 12 from a support assembly 14. A suspension stabilizer 15 is seen that engages the hook 12 and support assembly 14 to allow the light fixture 10 to maintain the particular orientation chosen when suspended. Each of these elements are shown in one preferred embodiment in FIG. 1.

Figure 2:
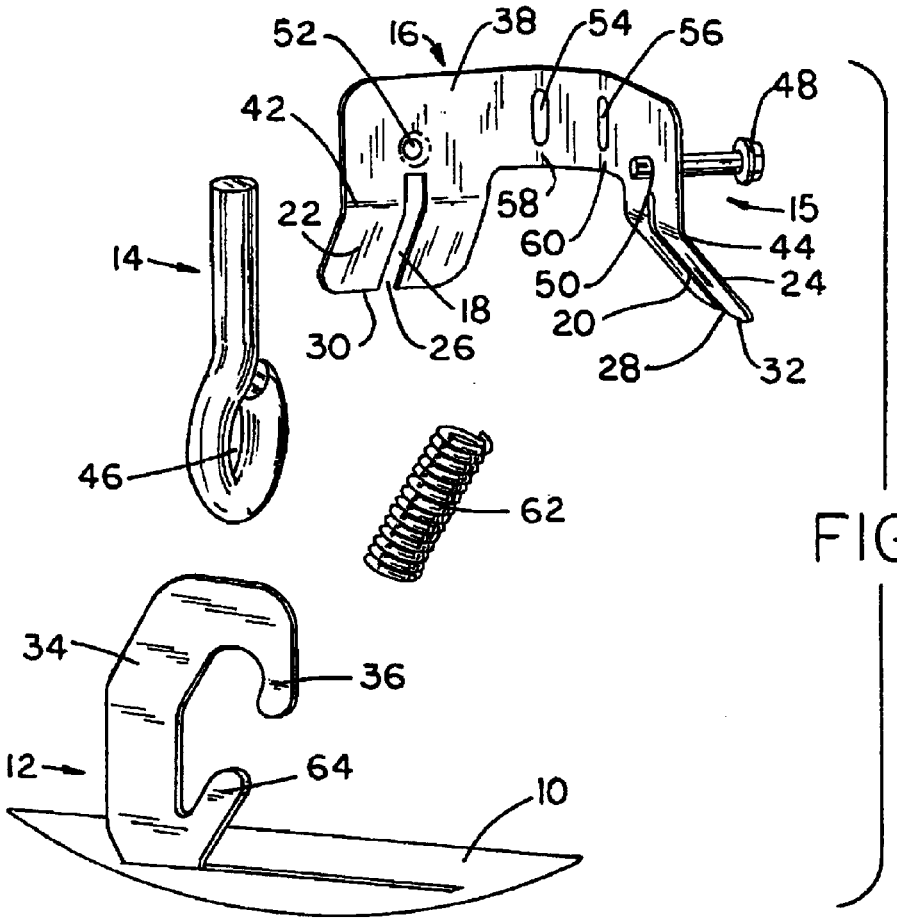
FIG. 2 is an exploded view of the suspension stabilizer.
Figure 5:
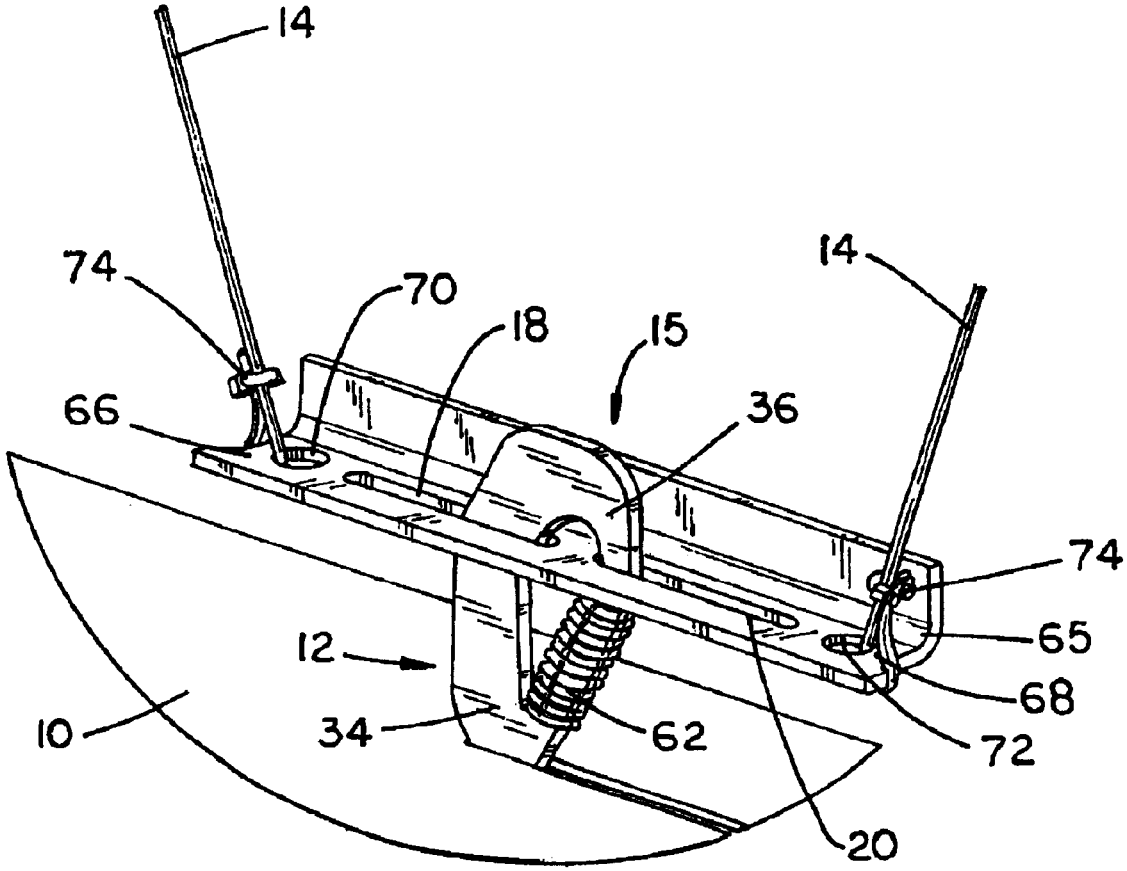
FIG. 5 is a perspective view of another embodiment of the suspension stabilizer as installed.

Referring to FIGS. 2 and 5, the suspension stabilizer 15 comprises a stabilizer body 16 having a first slot 18 and second slot 20. With the preferred embodiment shown in FIG. 2, first slot 18 and second slot 20 are defined by a first tab 22 and a second tab 24 respectively. Tabs 22 and 24 extend downward and at opposite ends of the upper member 25 of the stabilizer body 16. First slot 18 extends the length of first tab 22 and terminates in a first slot opening 26 at the first tab lower edge 30. Likewise, the second slot 20 extends the length of second tab 24 and terminates in second slot opening 28 at second tab lower edge 32.

Figure 1:
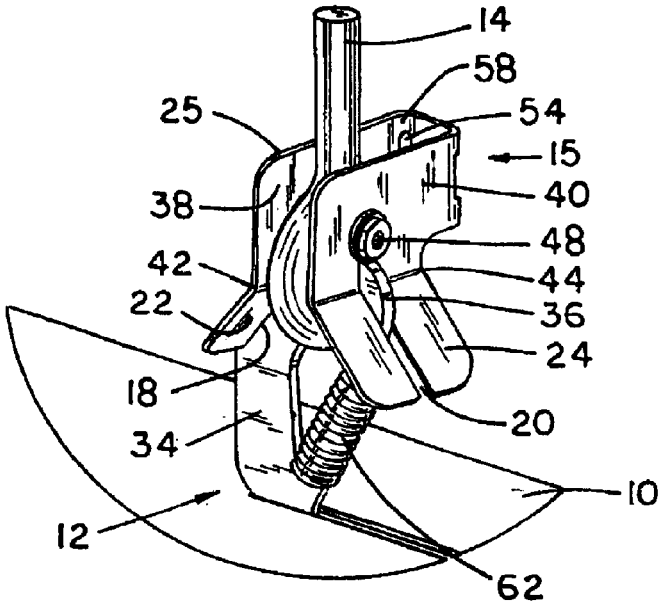
FIG. 1 is a perspective view of the suspension stabilizer as installed.

As seen in FIG. 1, the first slot 18 is sized to receive and frictionally hold the upward portion 34 of the hook 12 while the second slot 20 is sized to receive and frictionally hold the downward portion 36 of the hook 12. In a preferred embodiment, the thickness of the two portions 34 and 36 are nearly equivalent. In such an embodiment, both slots 18 and 20 are sized similarly so that each can receive either portion 34 or 36 of hook 12.

FIG. 1 shows that the upper member 25 has an inner surface 38 and an outer surface 40. In a preferred embodiment, first tab 22 and second tab 24 are bent outward in the direction of the outer surface 40 from the plane of the upper member 25 at first bend 42 and second bend 44 respectively. In a most preferred embodiment, each tab forms a 140° angle at bends 42 and 44 to the plane of the upper member 25. This configuration of the tabs 22 and 24 allows slots 18 and 20 to better straddle hook 12 and capture upward portion 34 and downward portion 36.

Figure 3:
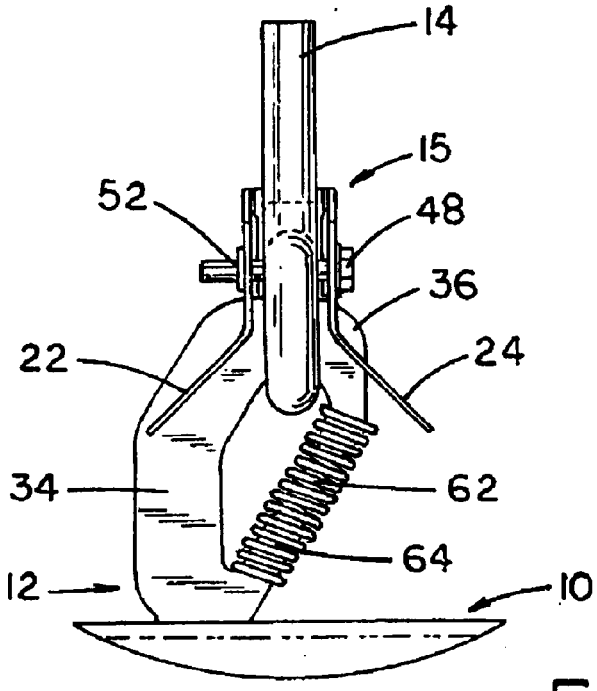
FIG. 3 is a side elevation view of the suspension stabilizer as installed.

In many embodiments, light fixture 10 is suspended from a support assembly 14 that has an opening 46 through which the hook 12 is inserted. In the most preferred of these embodiments, the support assembly 14 is an eye-bolt. In these embodiments, as seen in FIGS. 1–3, the stabilizer body 16 attaches to the support assembly 14 by a fastener 48. The fastener 48 passes through a fastener aperture 50, the opening 46 and a fastener sleeve 52. The fastener aperture is located above the second tab 24 in the upper member 25 and is sized to receive the fastener 48. The fastener sleeve 52 is located above the first tab 22 and extends outward from the outer surface 40 of the upper member 25. The fastener sleeve 52 is sized to receive the fastener 48. The fastener sleeve 52 allows for good holding power when the fastener 48 attaches to the stabilizer body 16 and is treaded through the fastener sleeve 52. In a most preferred embodiment, the fastener 48 is a self-threading metal screw.

In preferred embodiments, as shown in FIGS. 1–3, the suspension stabilizer 15 is used where the light fixture 10 is suspended from a hook 12 that is attached to the light fixture 10. In these embodiments, the hook 12 is inserted through the support assembly 14 and the support assembly 14 is attached to an overhead ceiling structure (not shown). In other preferred embodiments, the support assembly 14 is attached to the light fixture 10 and the support assembly 14 is inserted over the hook 12, where the hook 12 is attached to an overhead ceiling structure.

As seen in FIGS. 1–3, it is most preferred that the hook 12 be a flat hook. In many embodiments, the upward portion 34 and downward portion 36 of the hook 12 have a rectangular cross section with varying dimension.

Figure 4:
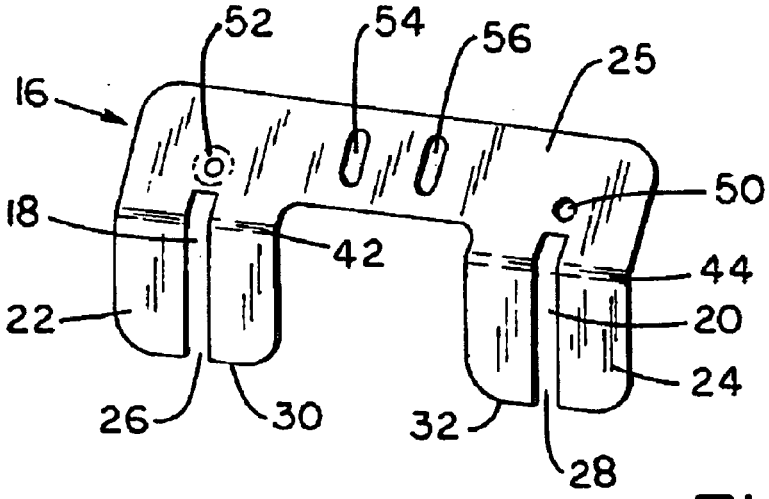
FIG. 4 is a perspective view of the suspension stabilizer in its preassembled configuration.

In highly preferred embodiments, the stabilizer body 16 undergoes assembly at the time of installation onto the hook 12. FIG. 4 shows a highly preferred form for the stabilizer body 16 prior to assembly. In such embodiments, the stabilizer body 16 is provided with a first perforation 54 and a second perforation 56 that are located on the upper member 25. First perforation 54 and second perforation 56 permit the stabilizer body 16 to be bent during assembly along first bending line 58 and second bending line 60 respectively as shown in FIG. 2. Bending lines 58 and 60 are spaced to permit the suspension stabilizer 15 to accommodate the thickness of the support assembly 14. The first perforation 54 and second perforation 56 are in registry with the fastener sleeve 52 and the fastener aperture 50 so that upon assembly the fastener sleeve 52 and the fastener aperture 50 are in alignment for attachment of the fastener 48.

During installation of the suspension stabilizer 15 in one of its preferred embodiments, verification that the light fixture 10, while suspended from the support assembly 14 by the hook 12, is in the preferred orientation to the area being illuminated is first performed. If not, the necessary corrections in the orientation of the light fixture 10 must be made next by changing the plane of the support assembly 14 or the plane of the hook 12 or both. With proper orientation of the light fixture 10, the assembled stabilizer body 16 as shown in FIG. 2 is placed over hook 12 and support assembly 14 so that slots 18 and 20 receive portions 34 and 36 of hook 12 and so that opening 46 is in alignment with fastener aperture 50 and fastener sleeve 52. As seen in FIGS. 1–3, fastener 48 passes through opening 46 by first being inserted through fastener aperture 50 and then threaded through fastener sleeve 52. The fastener 48 tightens the attachment of the stabilizer body 16 to the support assembly 14 as the threading of fastener 48 through fastener sleeve 52 is increased. Afterwards, a retaining spring 62 is placed between the downward portion 36 and the hook lip 64 to close off the hook 12 and secure the hook 12 to the support assembly 14.

In many preferred embodiments, the stabilizer body 16 is constructed from commercial quality cold-rolled steel. All slots, bends, and perforations prior to assembly are formed using normal metal-working techniques. Fastener aperture 50 is punched out and fastener sleeve 52 is extruded using such techniques.

In other preferred embodiments, as shown in FIG. 5, the stabilizer body 16 is a rail. The stabilizer body 16 is formed with a rail bend 65 to strengthen the stabilizer body 16. The stabilizer body 16 has a first rail end 66 and a second rail end 68. A first rail aperture 70 and a second rail aperture 72 are located at each rail end 66 and 68 respectively. The support assembly 14 is attached to the stabilizer body 16 at the rail apertures 70 and 72. In many such preferred embodiments, as seen in FIG. 5, the support assembly 14 consists of a pair of cables that are inserted individually through the rail apertures 70 and 72 and are secured by cable clamps 74.

In these preferred embodiments, the stabilizer body 16 has a first slot 18 and second slot 20 located between the rail apertures 70 and 72. The first slot 18 is sized to receive and frictionally hold the upward portion 34 of the hook 12 while the second slot 20 is sized to receive and frictionally hold the downward portion 36 of the hook 12. The separation between slots 18 and 20 on stabilizer 16 is sufficient to both support hook 12 and to allow portions 34 and 36 to engage slots 18 and 20.

As shown in FIG. 5, the hook 12 is attached to the light fixture 10 so that engaging the hook 12 with the suspension stabilizer 15 allows the light fixture 10 to be suspended from the support assembly 14. In a more preferred embodiment, the thickness of the two portions 34 and 36 are nearly equivalent. In such an embodiment, both slots 18 and 20 are sized similarly so that each can receive either portion 34 or 36 of hook 12.

During installation of these preferred embodiments, a determination is first made as to the plane of the hook 12 when the light fixture 10 is in the proper orientation to the area being illuminated. The stabilizer body 16 is then attached to the support assembly 14 so that the first slot 18 and second slot 20 are in a plane parallel to the proper plane for the hook 12 to insure the preferred orientation of the light fixture 10. After inserting hook 12 through slots 18 and 20 so that portion 34 and 36 are engaged, a retaining spring 62 is placed between the downward portion 36 and the hook lip 64 to close off hook 12 and secure hook 12 to suspension stabilizer 15.

While the principles of the invention have been shown and described in connection with specific embodiments, it is to be understood that such embodiments are by way of example and are not limiting.

What is claimed is:

1. In an overhead industrial light fixture of the type suspended in the air from an overhead ceiling structure by means of a hook from a support assembly, the hook having an upward portion and a downward portion, a suspension stabilizer comprising:

a stabilizer body having a first slot end a second slot wherein each slot is sized so that the upward portion is received in the first slot and the downward portion is received in the second slot; and a device for attaching the stabilizer body to the support assembly, whereby the light fixture maintains a particular orientation.

2. The suspension stabilizer of claim 1, wherein the support assembly has an opening through which the hook is inserted.

3. The suspension stabilizer of claim 2, wherein the support assembly is an eye-bolt.

4. The suspension stabilizer of claim 2, wherein the device is a fastener.

5. The suspension stabilizer of claim 2, wherein the hook is attached to the light fixture and the support assembly is attached to the overhead ceiling structure.

6. The suspension stabilizer of claim 2, wherein the support assembly is attached to the light fixture and the hook is attached to an overhead ceiling structure.

7. The suspension stabilizer of claim 1, wherein the hook is a flat hook.

8. The suspension stabilizer of claim 1, wherein the portions of the hook have a rectangular cross section.

9. The suspension stabilizer of claim 1, wherein the stabilizer body is a rail and the hook is attached to the light fixture, the rail having at least two apertures sized to receive the support assembly.

10. The suspension stabilizer of claim 9, wherein the nil has two ends and the device is a fastener at each end.

11. The suspension stabilizer of claim 1, wherein the stabilizer body has an inner surface with first and second inner portions, the first inner portion being in spaced relationship opposite to the second inner portion such that the support assembly is sandwiched between the inner portions.

12. The suspension stabilizer of claim 11, wherein the first slot is defined by a first tab contiguous with the first inner portion and the second slot is defined by a second tab contiguous with the second inner portion.

13. The suspension stabilizer of claim 12, wherein the tabs are angled outward from the support assembly.

14. The suspension stabilizer of claim 1, wherein the slots are substantially equal in size.

15. A method for stabilizing the orientation of an overhead industrial light fixture suspended in the air from an overhead ceiling structure comprising:

suspending the light fixture by a hook with upward and downward portions from a support assembly in a desired orientation;

placing a stabilizer body with a first slot and a second slot over the hook;

engaging the upward portion of the hook with the first slot;

engaging the downward portion of the hook with the second slot;

securing the stabilizer body to the support assembly.

16. The method of claim 15 wherein the securing of the stabilizer body to the support assembly is by engagement of a fastener.

17. The method of claim 15 wherein the stabilizer body is a rail and the hook is attached to the light fixture, the rail having at least two apertures sized to receive the support assembly.

18. The method of claim 17 wherein the rail has two ends and the securing of the stabilizer body to the support assembly is by engagement of a fastener at each end.

19. The method of claim 15, further comprising the step of assembling the stabilizer body prior to the placing step.

20. The method of claim 19, wherein the assembling of the stabilizer body includes bending the stabilizer body along two lines, whereby the first slot is aligned with the second slot.

* * * * *

UNITED STATES PATENT AND TRADEMARK OFFICE

CERTIFICATE OF CORRECTION

PATENT NO. : 6,783,265 B2
APPLICATION NO. : 10/294969
DATED : August 31, 2004
INVENTOR(S) : Eric Haugaard et al.

It is certified that error appears in the above-identified patent and that said Letters Patent is hereby corrected as shown below:

In the Claims:
Column 6, line 23, delete the word “nil” and replace with the word --rail--.

Signed and Sealed this

Nineteenth Day of December, 2006

JON W. DUDAS
*Director of the United States Patent and Trademark Office*